United States Patent [19]

Airola

[11] Patent Number: 4,815,606

[45] Date of Patent: Mar. 28, 1989

[54] APPARATUS FOR CONTAINING MULTIPLE DOSES OF A PHARMACEUTICAL PRODUCT

[76] Inventor: Gary Airola, 2210 Pacific Ave., Stockton, Calif. 95205

[21] Appl. No.: 48,865

[22] Filed: May 12, 1987

[51] Int. Cl.[4] ..... B65D 83/04

[52] U.S. Cl. ..... 206/532; 206/528; 206/538; 206/807; 220/284

[58] Field of Search ..... 206/1.5, 528, 531, 532, 206/534, 560, 562, 603, 807, 538, 539, 540; 220/19, 60, 284

[56] References Cited

U.S. PATENT DOCUMENTS

| | | | |
|---|---|---|---|
| 3,225,913 | 12/1965 | Lee | 206/534 |
| 3,728,480 | 6/1973 | Chesley | 206/534 |
| 4,120,400 | 10/1978 | Kotyuk | 206/528 |
| 4,372,445 | 2/1983 | Keffeler | 206/532 |
| 4,473,156 | 9/1984 | Martin | 206/534 |
| 4,527,707 | 7/1985 | Heymann et al. | 220/69 |
| 4,593,819 | 6/1986 | Will | 206/534 |
| 4,664,262 | 5/1987 | White | 206/532 |

*Primary Examiner*—David T. Fidei
*Attorney, Agent, or Firm*—Townsend & Townsend

[57] ABSTRACT

A multiple dose pharmaceutical container comprising a base having a plurality of base partitions forming a plurality of cavities for containing a pharmaceutical product. The base is formed of a material capable of suppressing the passage of ultraviolet radiation into the cavities. A foil sheet is disposed on the base and covers the plurality of cavities. A retainer is disposed on the base above the foil sheet for maintaining the foil sheet in place. For locking the retainer in place, a plurality of fasteners are disposed along a periphery of the base and extend vertically from the base. Each fastener has a groove for receiving an edge of the retainer and a generally horizontally surface which abuts an upper surface of the retainer for affixing the retainer to the base. Each fastener further has an inner surface disposed above and sloping away from the retainer for facilitating removal of the retainer from the base. A special tool is used disassembling the container. The tool comprises a tool base having a plurality of projections extending therefrom. Each projection has a surface for contacting the sloping surface of a corresponding fastener, so that each fastener is bent away from the retainer when the container is pressed toward the tool base. Latches are disposed in close proximity to selected projections for abutting a lower surface of the retainer and for holding the retainer against the tool base. A spring-loaded plunger is disposed in the tool base for pressing against each fastener and for pushing the container base away from the retainer while the retainer is held by the latch.

23 Claims, 3 Drawing Sheets

4

4

APPARATUS FOR CONTAINING MULTIPLE DOSES OF A PHARMACEUTICAL PRODUCT

BACKGROUND OF THE INVENTION

The invention relates to pharmaceutical containers and, more particularly, to a pharmaceutical container tray for storing multiple doses of a pharmaceutical product.

Pharmaceutical container trays often are used for storing multiple doses of a pharmaceutical product. For example, a tray may comprise a plurality of compartments wherein each compartment stores a daily dosage of a prescription drug. Typically, the compartments are arranged in rows and columns, and each row or column of compartments is covered by a plastic strip which slides along a channel.

When access to a particular compartment is desired, the plastic strip is slid along the channel to expose that compartment. However, in order to access the compartments toward the end of the row or column, it is necessary to remove the strip almost completely from the channel. This increases the risk that the strip will become misaligned and jam in the channel or be pulled out completely. As a result, the container is difficult to manipulate, and the number of compartments comprising a row or column is constrained by the practical length of the strip.

Another shortcoming of known container trays is that the slide and channel are not sufficiently sealed for protecting the contents from contamination by extraneous liquids, solids, or vapors, from loss of the drug, and from efflorescence, deliquescence, or evaporation under the ordinary or customary conditions of handling, shipment, storage, or sale. This is particularly true after the container is first opened. because access to the first compartment in a row usually exposes the remaining compartments to the ambient environment.

Most known container trays also are not sufficiently light-resistant for preventing deterioration of the contents beyond the official limits of strength. quality, or purity, Typically, the slide or base of the tray is transparent, and this allows ambient radiation to readily pass through, Sometimes, the slide or base of the tray is constructed of an opaque material, but the material used may be incapable of suppressing the passage of radiation in the ultraviolet spectrum which also deteriorates the product, Another shortcoming of conventional container trays is that they are reusable, and hence they frequently show no evidence of having been opened or tampered with, If a container is designed so as to show evidence of having been opened or tampered with, then the container ordinarily is incapable of any reuse, thus requiring the patient to purchase another container each time a prescription is filled, Consequently, the patient must spend more money for each prescription.

Finally, trays filled with prescription drugs must ordinarily be accompanied by instructions or charts for their use with a particular drug. Such printed material is usually kept separate from the container and is subject to being misplaced or otherwise lost. When this material is unavailable, treatment of the patient may be undermined.

SUMMARY OF THE INVENTION

The present invention is a multiple dose pharmaceutical container which is sufficiently sealed from the environment for preventing deterioration of the contents beyond the official limits of strength, quality, or purity under the ordinary or customary conditions of handling, shipment, storage, or sale, and for permitting withdrawal of successive doses without altering the strength, quality, or purity of the remaining doses. The container is designed so as to show evidence of each cavity having been accessed, but a pharmacist may refill and reuse the container with the aid of a special tool, In one embodiment of the present invention, a base has a plurality of base partitions forming a plurality of cavities for containing a pharmaceutical product, The base is formed of a material capable of suppressing the passage of ultraviolet radiation into the cavities, A foil sheet is disposed on the base for covering the plurality of cavities, and a retainer is disposed on the base above the foil sheet for maintaining the foil sheet in place. The retainer has a plurality of retainer partitions disposed above each base partition for forming apertures which align with the cavities. A seal is disposed on a lower surface of each retainer partition, and the foil sheet contacts the seal on each partition for hermetically sealing each cavity. For locking the retainer in place, a plurality of fasteners are disposed along a periphery of the base and extend vertically from the base. Each fastener has a groove for receiving an edge of the retainer and a generally horizontal surface which abuts an upper surface of the retainer for affixing the retainer to the base. Furthermore, each fastener has an inner surface disposed above and sloping away from the retainer. The sloping surface facilitates removal of the retainer from the base, so that the foil sheet may be replaced by the pharmacist when the container is refilled.

A special tool is used for disassembling the container. The tool comprises a tool base having a plurality of projections extending therefrom. Each projection has a surface for contacting the sloping surface of a corresponding fastener so that each fastener is bent away from the retainer when the container is pressed toward the tool base. Latches are disposed in close proximity to selected projections for abutting a lower surface of the retainer and for holding the retainer against the tool base. A spring loaded plunger is disposed in the tool base for pressing against each fastener and for pushing the container base away from the retainer while the retainer is held by the latch.

DETAILED DESCRIPTION OF THE PREFERRED EMBODIMENTS

Figure 1:
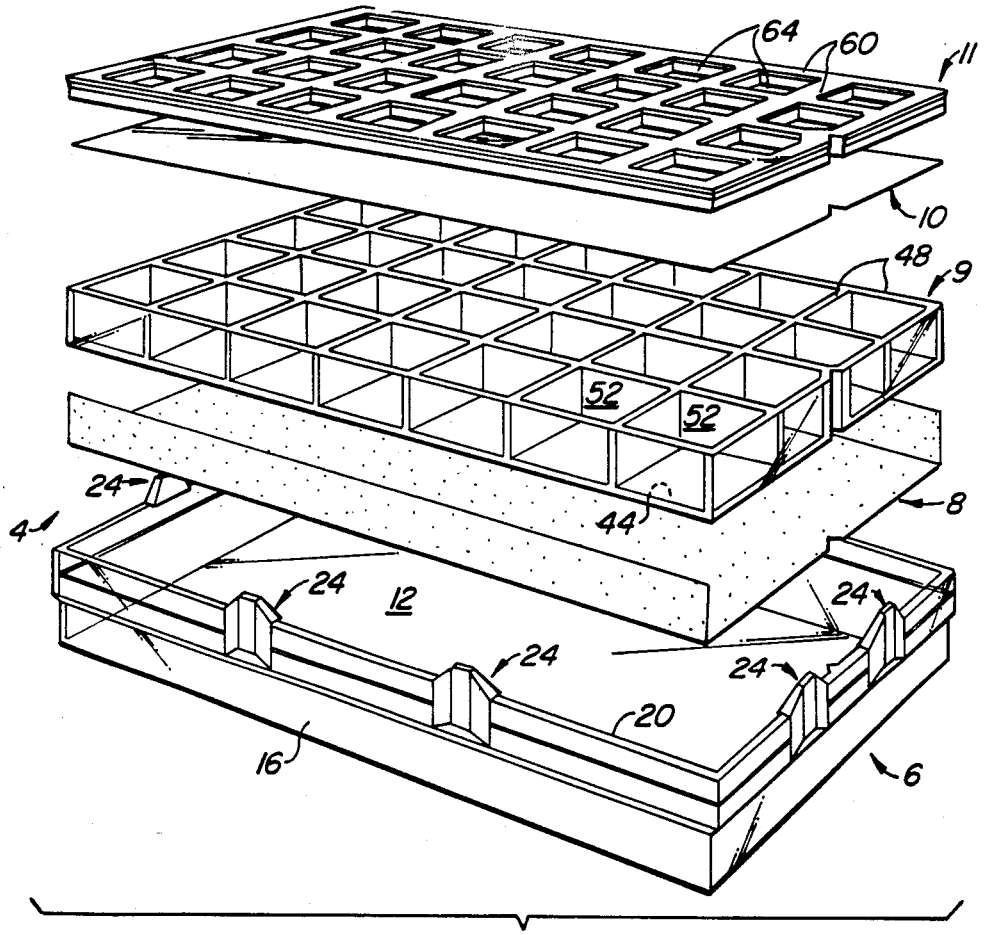
FIG. 1 is an exploded view of an apparatus for containing a pharmaceutical product according to the present invention.

FIGS. 1–4 are exploded, top and bottom views of a pharmaceutical container tray 4 for containing multiple doses of a pharmaceutical product. As shown in FIG. 1, container tray 4 comprises a base 6 a printed card 8, an inner base member 9, a foil sheet 10, and a retainer 11. Base 6 comprises a transparent bottom panel 12 and a wall extending around the perimeter of bottom panel 12. Disposed above wall 16 is a fastener wall 20 having a plurality of fasteners 24 formed therein. As shown in FIG. 2A, the inner surface of each fastener 24 has a groove 32 with a generally horizontal surface forming an abutment 36 for an upper surface 38 of retainer 11. Each fastener 24 further includes an inner surface 40 which slopes upwardly and away from retainer 11 for reasons discussed below.

As shown in FIG. 1, inner base member 9 comprises a lower panel 44 and a plurality of base partitions 48 forming cavities 52 for storing a pharmaceutical product. The upper surface of each base partition 48 has a projection 56, as more clearly seen in FIG. 2*b*, to help seal each compartment 52, as more fully described below. Foil sheet 10 is disposed on top of inner base member 9 for covering cavities 52. Base 6 and inner base member 9 preferably are formed of a substance which, in a thickness of 2 mms., does not transmit more than 18% of the incident radiation of any wavelength in the ultraviolet range between approximately 290 millimicrons and 450 millimicrons in order to prevent deterioration of the contents beyond official limits of strength, quality, or purity. If the desired plastic does not possess these properties, the material may be formed with an additive, such as Tinuvin 622, readily available from Ciba-Giegy Corp. Foil sheet 10 prevents radiation from entering cavities 52 from above container tray 4.

Figure 2A:
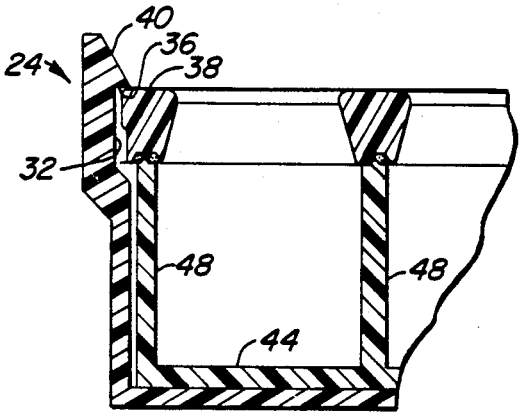
FIG. 2 is a cross-sectional view of a portion of the tray of FIG. 1 illustrating the locking mechanism used for affixing the retainer to the base.
FIG. 2*b* is a view illustrating the seal between the retainer and the base.
Figure 2B:
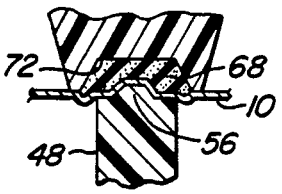
Figure 3:
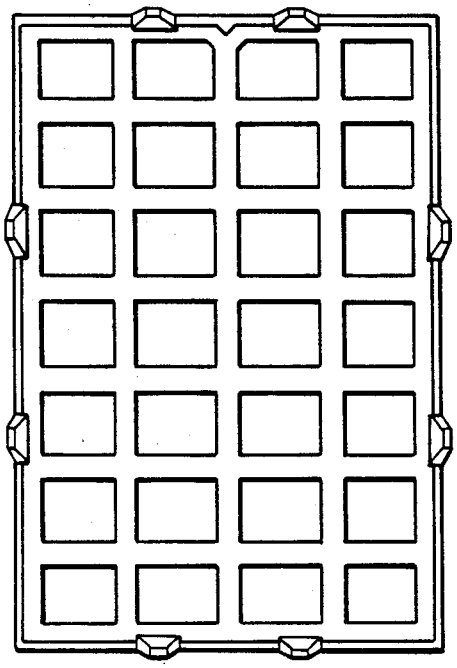
FIG. 3 is a top view of the apparatus of FIG. 1.
Figure 4:
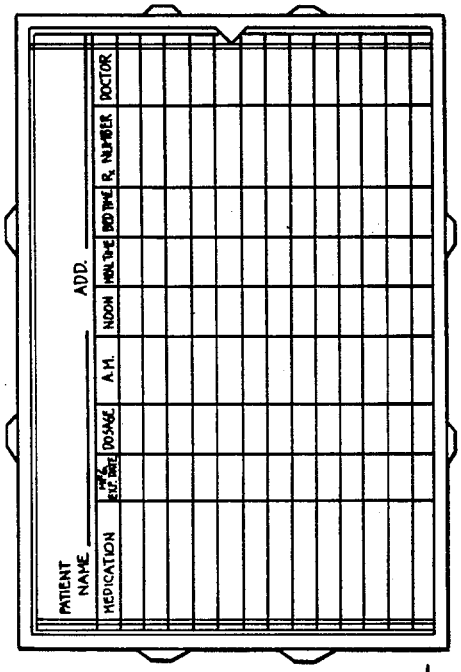
FIG. 4 is a bottom view of the apparatus of FIG. 1.

Retainer 11 maintains foil sheet 10 in position over inner base member 9 so that foil sheet 10 cannot be removed by the patient. As shown in FIG. 1, retainer 11 comprises a plurality of retainer partitions 60 forming a plurality of apertures 64. Each retainer partition 60 is disposed above a corresponding base partition 48 and has a sanoprene seal 68 fitted within a groove 72, as shown in FIG. 2*b*. Groove 72 preferably extends along the entire length of each retainer partition 60. When assembled, retainer 11 is placed over inner base member 9 so that seal 68 in each retainer partition 60 presses foil sheet 10 against projections 56 on each base partition 48. The edges of retainer 11 are horizontally received within grooves 32 of each fastener 24 and are held in place by abutment 36 pressing against the upper surface 38 of retainer 11. The resulting structure forms individual, hermetically sealed cavities 52, which contain individual doses of a pharmaceutical product accessible by tearing the portion of foil sheet 10 overlying a particular cavity. Once foil sheet 10 is torn, it provides an indication that a particular cavity 52 has been accessed and prevents reuse of the container by the patient.

Figure 5:
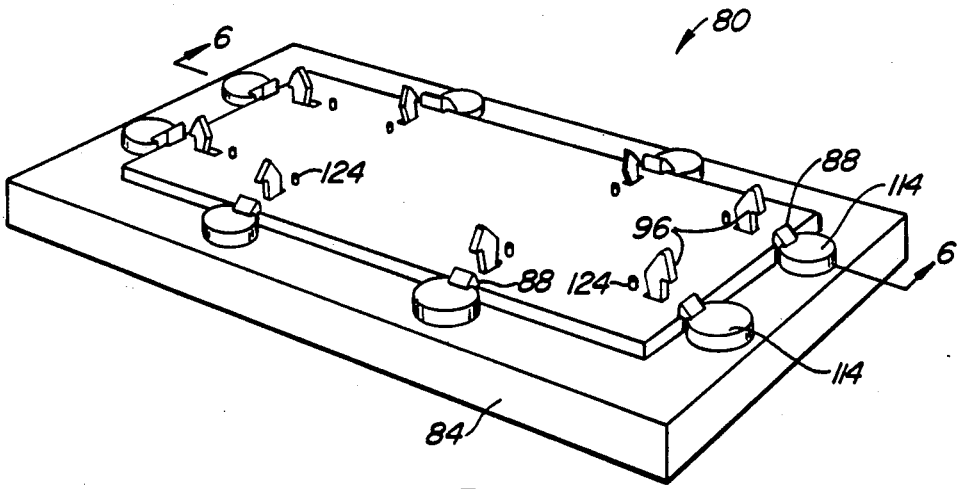
FIG. 5 is a perspective view of a tool according to the present invention for disassembling the apparatus of FIG. 1.
Figure 6:
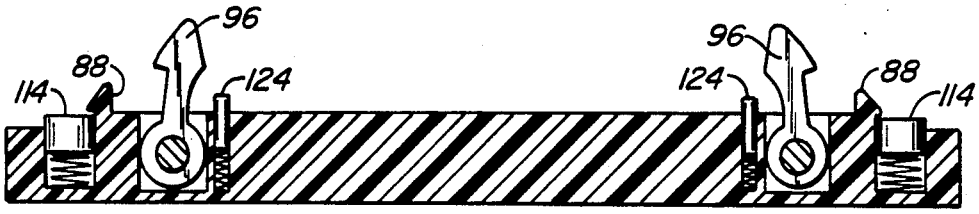
FIG. 6 is a cross-sectional view of the tool taken along line 6—6 of FIG. 5.
Figure 7:
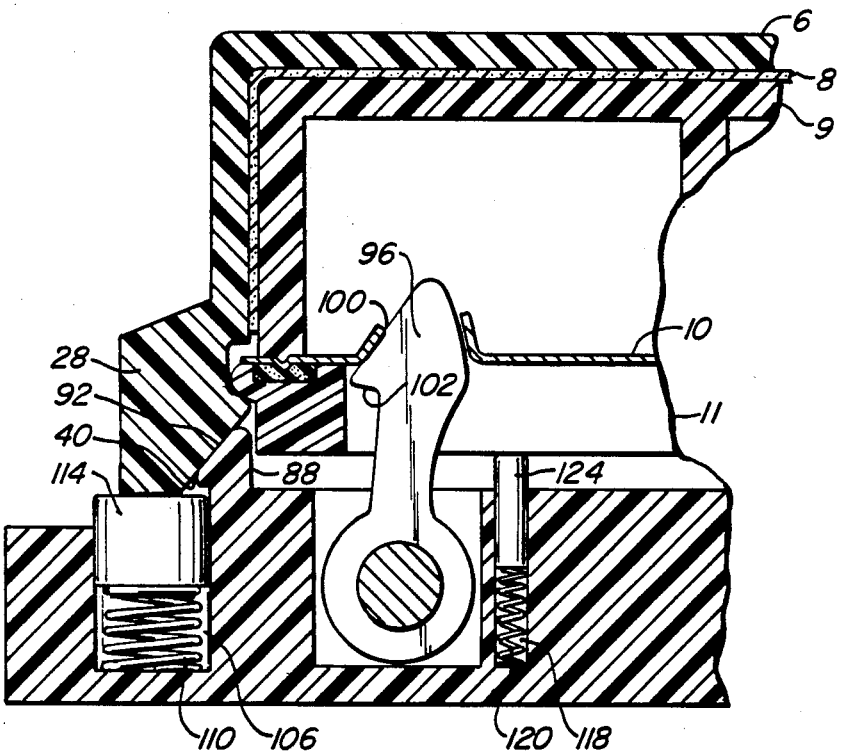
FIG. 7 is a cross-sectional view of the tool of FIG. 5 in a position of use with the apparatus of FIG. 1.

For disassembling container 4, a tool 80, illustrated in FIGS. 5 and 6, may be used by the pharmacist. Tool 80 comprises a tool base 84 from which a plurality of projections 88 extend. Each projection 88 has a surface 92 for contacting the sloping surface 40 of a corresponding fastener 24, so that each fastener 24 is bent away from retainer 11 when container tray 4 is pressed toward tool base 84. Tool 80 further comprises one or more, preferably 4, latches 96 pivotally connected to tool base 84 and biased toward the outer edges of tool base 84 by suitable springs (not shown). Each latch 96 includes a convex surface 100 and a horizontal surface 102 for contacting a lower surface 104 of retainer 11 (FIG. 7). Disposed adjacent to each projection 88 is an outer bore 106 containing a spring 110 and an outer plunger 114. Each outer plunger 114 is located for contacting an associated fastener 24 for biasing base 6 away from retainer 11 after fasteners 24 are bent. Finally, tool base 84 includes a plurality of inner bores 118, each having a spring 120 and an inner plunger 124 therein for biasing retainer 11 away from tool base 84 after retainer 11 is released from latches 96.

In operation, the pharmacist enters the desired information on card 8, places card 8 face down against transparent bottom panel 12, and places inner base member 9 on top of card 8. Foil sheet 10 is placed over inner base member 9, and retainer 11 is placed over foil sheet 10 and pressed down until the edges of retainer 11 are received within grooves 32 of each fastener 24 and held in place by abutments 36. Card 8 and foil 10 thus are locked in place by retainer 11. Because of the number of fasteners 24, it is very difficult, if not impossible, for a patient to remove retainer 11. The patient accesses each dose by tearing the portion of foil 10 above the desired cavity 52. Since foil 10 is locked in place by retainer 11, the torn foil sheet portion remains as an indication that the cavity 52 has been accessed.

When the patient has completely emptied the tray, he or she may bring the tray to the pharmacist for refilling. The pharmacist then takes the tray and places it upside down against tool 80 so that the sloping surface 40 of each fastener 24 contacts a corresponding surface 92 of a projection 88 extending from tool base 84. As the pharmacist presses down on container tray 4, fasteners 28 are bent away from retainer 11 until the edges of retainer 11 are no longer received within grooves 32. When container tray 4 is fully depressed, each latch 96 pivots so that surfaces 102 contact lower surface 104 of the retainer and hold the retainer in place against tool base 84. The pharmacist then may relieve the pressure from container 4, and plunger 114 press base 6 away from retainer 11. Inner base member 9 then may be removed and latches 96 pivoted for releasing retainer 11 from tool base 84 by the spring action of plungers 124. Foil sheet 10 then may be discarded, the container refilled, and a new foil sheet 10 placed over inner base member 9 and locked in place by retainer 11.

While the above is a complete description of a preferred embodiment of the present invention, various modifications are obvious to those skilled in the art. For example, base 6 and inner base member 9 may be integrally formed, and the number of fasteners 24 may be increased or decreased, as desired. Latches 96 may be omitted, and a plastic cover may be placed over retainer 11 to protect foil 10 prior to use. Consequently, the description should not be used to limit the scope of the invention, which is properly described in the claims.

I claim:

1. An apparatus for containing multiple doses of a pharmaceutical product comprising:

a container base having a plurality of cavities therein for containing a pharmaceutical product;

indicator means, removably disposed on the base, for providing an irreversible indication when a cavity has been accessed;

a retainer in contact with the indicator means for maintaining the indicator means disposed on the base; and lock means, disposed on the base and contacting the retainer, for preventing the retainer, and therefore the indicator means, from being removed.

2. The apparatus according to claim 1 further comprising cover means for covering the plurality of cavities.

3. The apparatus according to claim 1 further comprising seal means, associated with the cover means, for hermetically sealing each cavity.

4. The apparatus according to claim 3 wherein the cover means comprises a sheet disposed over the plurality of cavities.

5. The apparatus according to claim 4 wherein the sheet is torn to gain access to each cavity, the torn sheet forming the indicator means.

6. An apparatus for containing multiple doses of a pharmaceutical product comprising:

a container base having a plurality of cavities therein for containing a pharmaceutical product;

a sheet disposed over the plurality of cavities, the sheet being torn to gain access to each cavity, the torn sheet indicating when a cavity has ben accessed;

a retainer in contact with the sheet for maintaining the sheet in place of the base; and lock means, disposed on the base, for preventing the sheet from being removed.

7. The apparatus according to claim 6 wherein the lock means comprises a plurality of fasteners disposed on the base for affixing the retainer to the base.

8. The apparatus according to claim 6 wherein each fastener has a groove for receiving an edge of the retainer therein.

9. The apparatus according to claim 8 wherein the retainer is received horizontally within each groove.

10. The apparatus according to claim 9 wherein the plurality of fasteners encircle the retainer.

11. The apparatus according to claim 10 wherein each fastener is oriented vertically and has an inner surface above and sloping away from the retainer.

12. The apparatus according to claim 11 further comprising unlocking means for bending a fastener away from the retainer so that the edge of the retainer is removed from the corresponding groove.

13. The apparatus according to claim 12 wherein the unlocking means simultaneously bends each fastener away from the retainer so that the edge of the retainer is removed from each groove.

14. The apparatus according to claim 13 wherein the unlocking means comprises:

a tool base, the base having a plurality of surfaces for contacting the sloping surface of an associated fastener so that each fastener is bent away from the retainer when the container base is pressed toward the tool base.

15. The apparatus according to claim 14 wherein the unlocking means further comprises:

a latch connected to the base, the latch having a surface for abutting against a lower surface of the retainer when the retainer is pressed toward the tool base.

16. The apparatus according to claim 15 further comprising biasing means for biasing the container base away from the retainer after the fasteners are bent.

17. In a container comprising first and second members wherein the second member is affixed to the first member by a plurality of fasteners extending from the first member and receiving the second member, each fastener having a groove for receiving an edge of the second member therein and an inner surface above and sloping away from the second member, a tool for separating the first and second members, comprising:

a tool base; and a plurality of projections extending from the tool base, each projection having a surface for contacting the sloping surface of a corresponding fastener so that each fastener is bent away from the retainer when the first member is pressed toward the tool base; and a latch connected to the base in close proximity to a projection, the latch having a surface for abutting a surface of the second member which faces the first member when the first member is pressed toward the tool base.

18. The tool according to claim 17 further comprising biasing means, disposed on the tool base, for biasing the first member away from the second member after the fasteners are bent.

19. An apparatus for containing multiple doses of a pharmaceutical product comprising:

a base having a plurality of base partitions forming a plurality of cavities for containing a pharmaceutical product;

a foil sheet disposed on the base and covering the plurality of cavities:

a retainer disposed on the base, the retainer having a plurality of retainer partitions disposed above each base partition:

a seal disposed on a lower surface of each retainer partition, the foil contacting the seal disposed on each partition: and a plurality of fasteners disposed along a periphery of the base and extending vertically therefrom, each fastener having a generally horizontal surface facing an upper surface of the retainer for affixing the retainer to the base, and each fastener having an inner surface above and sloping away from the retainer.

20. The apparatus according to claim 19 wherein the base is formed of a material which, in a thickness of approximately 2 mm. does not transmit more than approximately 18% of the incident radiation of any wavelength in the ultraviolet range between approximately 290 millimicrons and approximately 450 millimicrons.

21. The apparatus according to claim 10 wherein the plurality of fasteners must be simultaneously bent away from the retainer in order to remove the retainer and the sheet from the base.

22. The apparatus according to claim 1 wherein the base is formed of a material which, in a thickness of approximately 2 mm, does not transmit more than approximately 18% of the incident radiation of any wavelength in the ultraviolet range between approximately 290 millimicrons and approximately 450 millimicrons.

23. An apparatus for containing multiple doses of a pharmaceutical product for access by a user comprising:

a container base having a plurality of cavities therein for containing a pharmaceutical product;

indicator means, removably disposed on the base, for providing an irreversible physical indication when a cavity has been accessed;

a retainer removably disposed on the indicator means; and lock means, disposed on the base, for preventing the retainer from being manually removed by any user of the pharmaceutical product without a tool, so that the indicator means cannot be removed or replaced.

* * * * *